United States Patent [19]

Allebach

[11] Patent Number: 4,615,197

[45] Date of Patent: Oct. 7, 1986

[54] THREAD ROLLING MONITORING SYSTEM

[75] Inventor: Gene E. Allebach, Tiffin, Ohio

[73] Assignee: The National Machinery Company, Tiffin, Ohio

[21] Appl. No.: 657,950

[22] Filed: Oct. 5, 1984

[51] Int. Cl.[4] ..... B21H 3/06

[52] U.S. Cl. ..... 72/88; 10/10 R; 10/27 R; 10/153; 72/21; 72/26; 72/31; 72/90; 73/862.54; 340/680

[58] Field of Search ..... 72/88, 90, 21, 19, 1, 72/26, 31; 10/153, 10 R, 27 R; 33/DIG. 13; 73/862.54, 862.06; 340/680, 665, 540

[56] References Cited

U.S. PATENT DOCUMENTS

| | | | |
|---|---|---|---|
| 1,979,919 | 11/1934 | Wayne | 72/90 |
| 3,596,506 | 8/1971 | Wilson, Jr. | 73/862.06 |
| 3,665,742 | 5/1972 | Felt et al. | 72/31 X |
| 4,168,458 | 9/1979 | Bouwman | 318/603 |

FOREIGN PATENT DOCUMENTS

| | | | |
|---|---|---|---|
| 0039821 | 4/1981 | Japan | 10/10 R |
| 0460925 | 2/1975 | U.S.S.R. | 72/90 |

*Primary Examiner*—Francis S. Husar
*Assistant Examiner*—Steve Katz
*Attorney, Agent, or Firm*—Pearne, Gordon, Sessions Granger & Tilberry

[57] ABSTRACT

A thread rolling monitoring system in which one or more signal generating devices is provided in the mounting system of the stationary die of a pair of thread rolling dies. A sensor develops a signal which is a function of the reaction forces in a direction substantially parallel to the axis of the workpiece being threaded. The signal provides a running indication of the match or mismatch of the dies, as well as other conditions of improper operation. The signal is used to control the operation of the machine and to separate improperly formed parts as they are produced.

15 Claims, 5 Drawing Figures

FIG.4
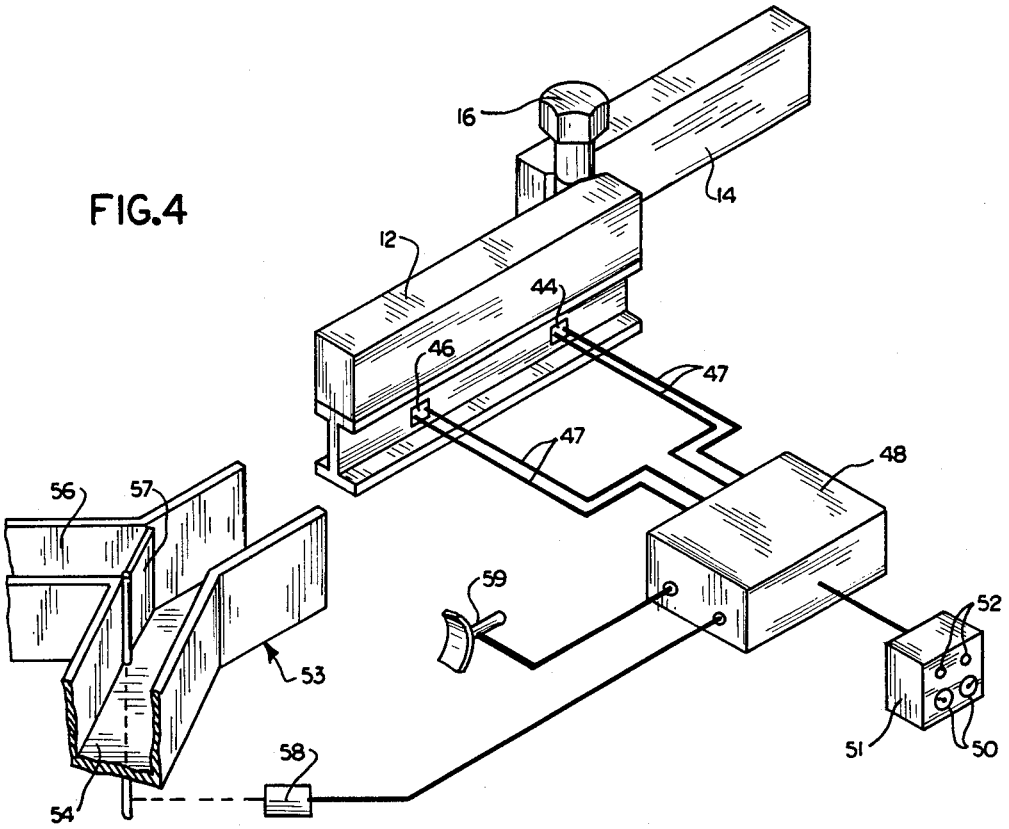
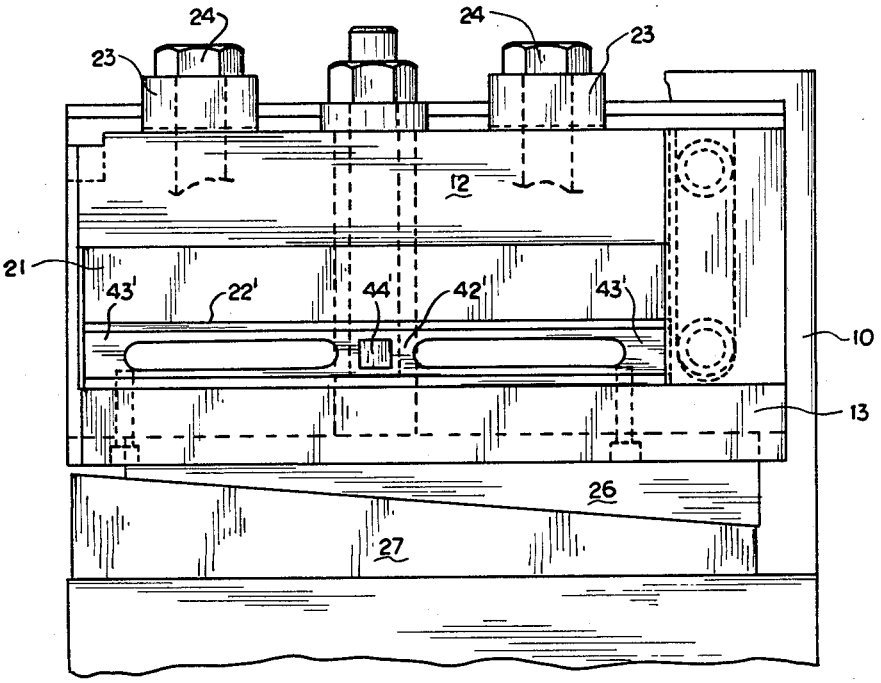
FIG.5

THREAD ROLLING MONITORING SYSTEM

BACKGROUND OF THE INVENTION

This invention relates generally to thread rolling machines, and more particularly to a novel and improved thread rolling machine incorporating means to monitor the thread rolling operation while the machine is running.

PRIOR ART

Flat die thread rolling machines generally provide a fixed die holder and a movable die holder which reciprocates back and forth adjacent to the fixed die holder. A pair of dies are mounted on the die holders, and when a pusher inserts a blank or workpiece between dies, a thread or other desired form is rolled on the blank surface as the blank rolls between the dies.

In order for the threads to be properly formed in a reliable manner, it is essential that the dies be precisely positioned with respect to each other, and that the machine operates through repeated cycles in a uniform manner so that each successive blank is rolled in exactly the same way. There are a number of different conditions which can exist to cause improper rolling operation.

(1) One of the dies may be adjusted too high or too low relative to the other die at the position where the blank starts through the dies. This produces a condition generally referred to as "mismatch of the dies."

(2) If the machine is worn or improperly maintained, the dies may not travel in an exact parallel manner with respect to each other.

(3) The blank may slip on one of the opposing die surfaces during the rolling process, causing a mismatch to occur. This usually occurs at the start of the rolling operation and can result from improper pusher operation.

(4) If the axis of the blank is not perpendicular to the direction of die movement, the blank will wobble while it is being rolled.

(5) If the dies are not formed with identical helix angles, the match of the dies is not maintained during the rolling operation.

If any one or more of the foregoing conditions exists, the threads formed on the blank being rolled may be improperly formed and excessive die wear may occur.

When a mismatch condition occurs, the threads formed on the workpiece by one die do not properly match the thread forms on the other die, e.g., they are too high or too low. When this occurs, a reaction force is developed in a direction parallel to the axis of the workpiece. On the other hand, when the dies and workpiece are properly matched, such reaction force does not exist, or is very small.

Generally in the past, the match of the dies was determined during the set-up of the dies and not while the machine was running. During set-up, a blank was fed into the dies and the machine was jogged to cause the blank to be rolled through about one-half a turn. The blank was then backed out and inspected to see if the thread forms on the two halves of the blank were aligned. If proper alignment was not present, the dies were adjusted and the process was repeated. Because the machine was not running during this operation, a proper running match might not be provided even though the nonrunning set-up provided a proper match.

Systems have been proposed to sense one or more of these improper conditions. One such system is described in U.S. Pat. No. 4,168,458. In that system, timing pulses are generated and are used to measure the time the blank is between the dies. If the blank is between the dies an improper length of time, it is assumed that the thread formed on the blank is improperly formed.

It is also known to measure the separation force, the force normal to the die faces, to determine if the reaction force on the dies caused by the blanks rolling therebetween deviates from a normal value.

The first of such systems involving timing pulses depends on indirect measurements, and does not provide an accurate indication of the thread forming operation. The latter of such systems does not provide a direct measurement of mismatch. Also, it is difficult to detect the variations in die separating forces cuased by improper rolling because the force variations are small compared to the very large die separating forces which occur in normal rolling operations.

SUMMARY OF THE INVENTION

In accordance with the present invention, signals are generated while the machine is running which permit determination of substantially all of the various conditions of improper thread rolling as the blanks are being threaded. Such systems allow the operator to establish if the threads are being properly formed, and, in some instances also, the cause of improper forming when problems are encountered.

In accordance with this invention, a signal is generated which establishes the presence and value of die reaction forces in a direction substantially parallel to the axis of the blank being threaded. Such signal provides a direct and accurate measurement of die match or mismatch.

In one illustrated embodiment, separate signals are generated by sensors spaced along the length of the stationary die. By comparing such signals, it can be determined whether the dies are running parallel. Further, it can be determined if the match is maintained during the process. Still further, if the blank does not roll straight but, rather, wobbles, it produces reaction forces which in turn produce detectable signals.

In another embodiment, a single sensor is provided. In such embodiment, the signal again establishes the proper or improper rolling action.

These signals allow a running determination that the dies are properly set up. Further, these signals allow automatic rejection of improperly formed blanks so that a uniform high quality production is achieved. The signals may be used also to establish the trend of any change which is occurring in the operation of the machine, allowing the operator to take corrective action when necessary to ensure high quality production. Further, such signals allow for the automatic machine shutdown if and when conditions occur which could cause machine damage or substantial deterioration in the quality of production.

In the illustrated embodiments, a sensor beam is positioned below the fixed die of a flat die thread rolling machine. Toe clamps engage the opposite side of the die and clamp the die toward the sensor beam. The beam is provided with lateral pillars through which the clamping forces pass to the machine frame.

When a blank is improperly rolled and produces a reaction force on the die in a direction parallel to the blank axis, the stress within the pillars changes. If the reaction force is in an upward direction, the stresses decrease. If the reaction force is in a downward direction, the stresses increase. Strain gauges are applied to one or more of the pillars, and generate a signal or signals which have a value which is a function of the stress and resulting strain in the pillars.

The output signals of the load cells or sensors are supplied to a microprocessor which evaluates the signals and is programmed to establish that the loads on the dies are within the proper levels to indicate proper thread rolling operation or that the value of the signals is outside proper levels to indicate improper thread rolling operation.

Such microprocessor is programmed to provide the operator with a visual or audio signal indicating the condition of operation, automatically reject improperly threaded blanks, and to automatically shut down the machine if a condition exists which requires corrective action, or which can cause machine damage.

These and other aspects of this invention are illustrated in the accompanying drawings and are more fully described in the following specification.

BRIEF DESCRIPTION OF THE DRAWINGS

FIG. 4 is a schematic view illustrating the machine and the control system which operates in response to the generated signals to control the operation of the machine; and FIG. 5 is a side elevation similar of FIG. 3 but illustrating a second embodiment which provides only a single sensor.

DETAILED DESCRIPTION OF THE DRAWINGS

Figure 1:
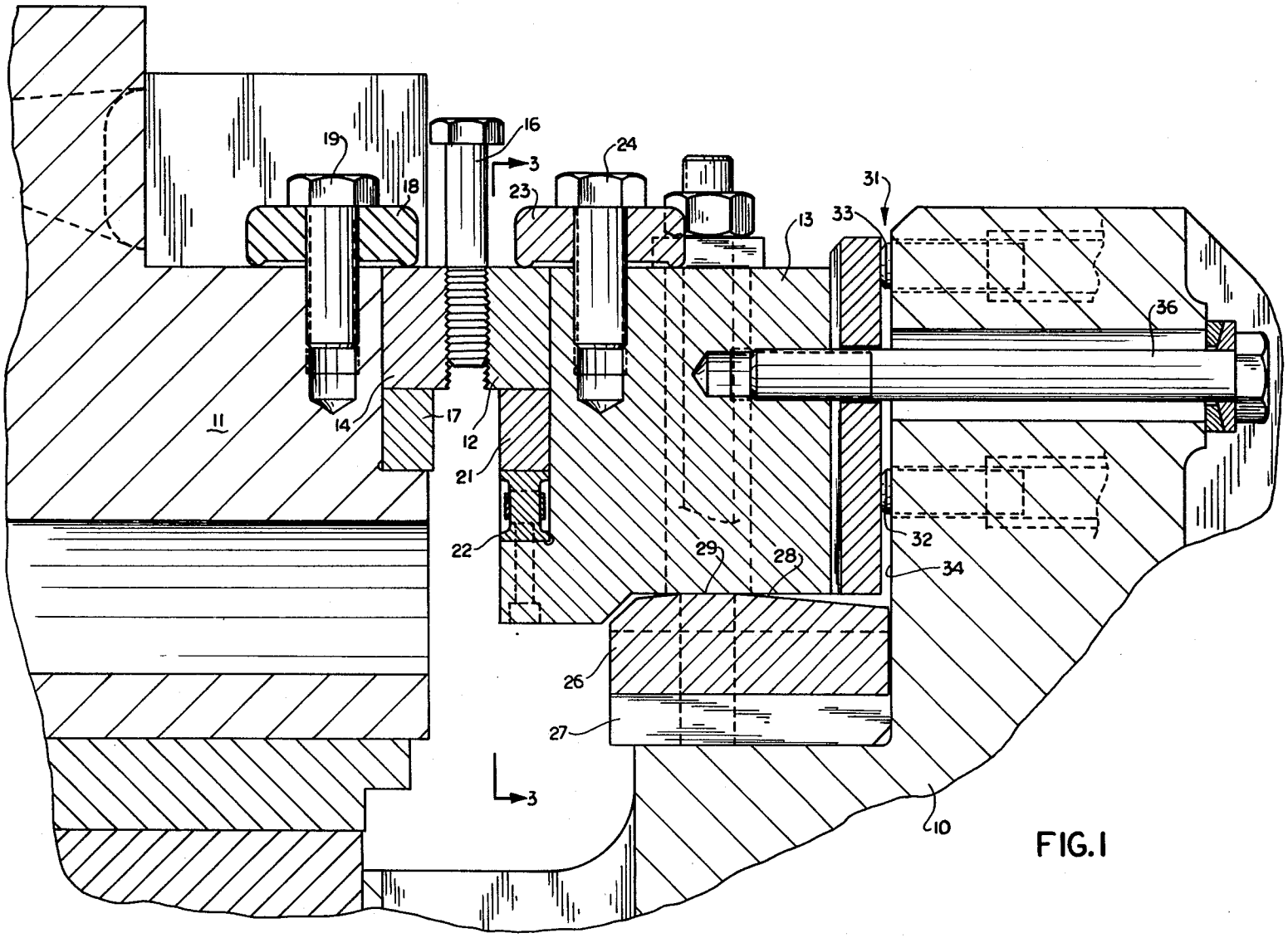
FIG. 1 is a vertical cross section illustrating a flat die thread rolling machine incorporating this invention.

FIG. 1 illustrates a relatively conventional flat die thread rolling machine which incorporates the present invention. Such machine includes a frame 10 and a slide 11 mounted on the frame 10 for reciprocation by a drive system (not illustrated) which usually includes a crank and pitman drive.

A stationary die 12 is mounted in a die block 13 which is, in turn, adjustably mounted on the frame 10. A reciprocating die or movable die 14 is mounted on the slide 11 for reciprocation back and forth relative to the fixed die 12. The two dies 12 and 14 cooperate to roll a thread on a workpiece 16 when the workpiece is moved by a pusher 15 into a position between the dies. In FIG. 1, the workpiece illustrated is a typical hex head bolt. However, it should be understood that other types of workpieces can be rolled in a machine incorporating the present invention.

The movable die 14 is mounted in the die pocket above a spacer block 17, and is clamped in position by toe clamps 18 and toe clamp bolts 19. The fixed or stationary die 12 is mounted in the die pocket of the die block 13 above a spacer 21. However, the spacer 21 is supported above a sensor beam 22, as discussed in greater detail below. Here again, toe clamps 23 and toe clamp bolts 24 operate to clamp the die 12 down against the spacer 21 and sensor beam 22.

The die block 13 is mounted within the frame 10 of the machine so that it can be adjusted in a number of different directions. The vertical position of the die block 13, and in turn the vertical position of the fixed die 12, is determined by a pair of wedges 26 and 27, best illustrated in FIGS. 1 and 3. Such wedges are adjusted to adjust the vertical position of the die block.

Figure 2:
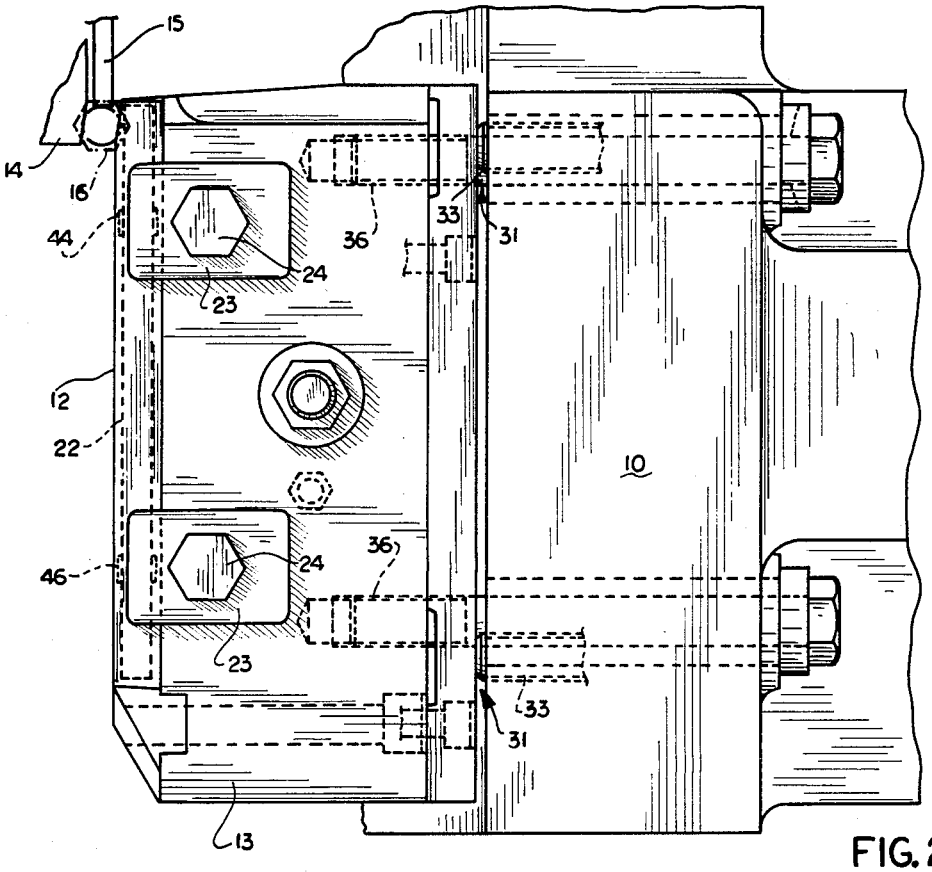
FIG. 2 is a plan view of the fixed die and its support structure.

As best illustrated in FIG. 1, the upper surface 28 of the wedge 26 is shaped so as to provide clearance with respect to the die block on either side of a central contact zone 29. The lateral position of the die block and the degree of tipping thereof are controlled by two sets of adjusting bolts 31. One set of bolts 31 is located substantially adjacent to the entrance end of the die, and the other set is located substantially adjacent to the exit end of the die, as best illustrated in FIG. 2. Each set includes a stud bolt 32 located in the frame 10 at a level near the lower end of the die block and a second stud bolt 33 located in the frame 10 substantially at the top of the die block 13. Each of the stud bolts 32 and 33 is individually adjustable with respect to the frame, and projects a small distance beyond a face 34 in the frame 10. Each set also includes a draw bolt 36 which extends through a passage in the frame and is threaded into the backside of the die block. The draw bolt operates a pull the die block back against the ends of the stud bolts 32 and 33 so as to clamp the die block in a position determined by the adjusted positions of the stud bolts 32 and 33. By appropriate adjustment of the stud bolts, the die block can be tipped a small amount and the ends of the die blocks can be adjusted independently to the left or the right, as viewed in FIG. 3.

The system thus far described for adjusting the position of the stationary die with respect to the slide 11 and the movable die 14 is well known to those skilled in the art, and is illustrated as one example of a die adjusting system for a thread roller.

Figure 3:
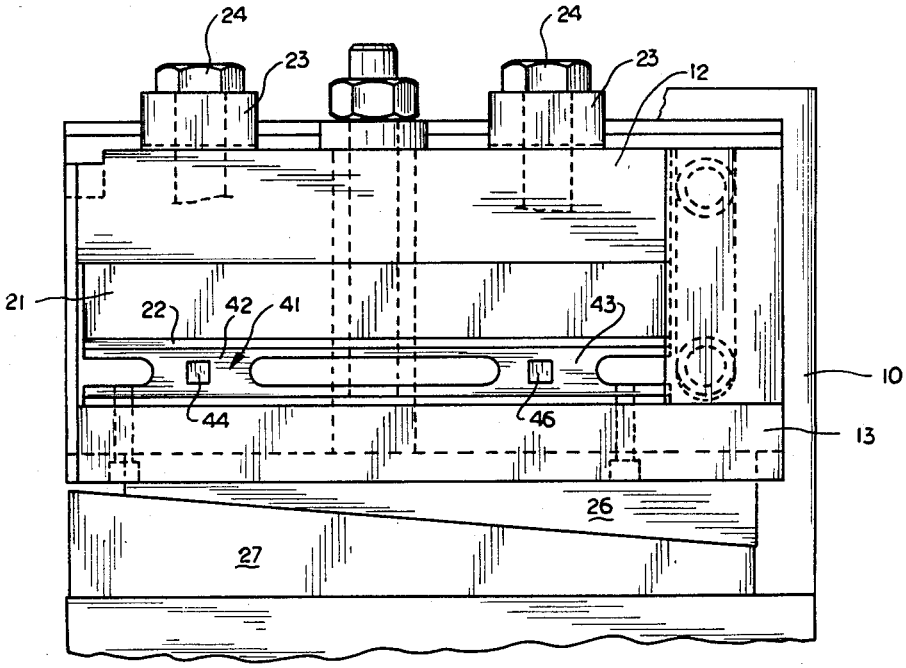
FIG. 3 is a side elevation of the fixed die and supporting structure taken along line 3—3 of FIG. 1, illustrating the signal generating and die support structures.

Referring to FIGS. 1 and 3, the sensor beam 22 is provided with a generally I-shaped cross section, but the central web 41 is cut out so as to provide two longitudinally spaced columns 42 and 43 which transmit vertical loads from the upper flange of the sensor beam to the lower flange. Secured to such columns are signal generating devices 44 and 46 which produce signals which are a function of the strain in the columns 42 and 43. Preferably, such signal generating devices 44 and 46 are typical strain gauges which are capable of producing electrical signals that are a function of the strain which exists in the column to which they are cemented.

In the embodiment of FIG. 3, one of the strain gauges 44 is located below the fixed die 12 substantially adjacent to the entrance end of the die, and the strain gauge 46 is located beneath the die substantially adjacent to the exit end of the die. The strain gauges sense the reaction force in the fixed die in a direction parallel to the workpiece axis. In order to simplify the understanding of this invention, such reaction force direction will be referred to as vertical or upward or downward. Similarly, the die separating forces in a direction perpendicular to the die faces created by the workpieces are referred to as horizontal forces.

FIG. 4 is a schematic representation of the connection of the strain gauges to the control system of the machine. As illustrated in FIG. 4, wires 47 connect each of the strain gauges 44 and 46 to a microprocessor 48. Since the sensors are associated with the fixed die, and are therefore also fixed, the wiring does not flex when the machine operates. Since the columns 42 and 43 are pre-loaded by the toe clamps 23, a signal is generated by the two strain gauges 44 and 46 when a bolt is not being rolled that is a function of the pre-load created by the toe clamps. This signal is the neutral signal of the system.

In the event that a bolt being rolled by the dies creates an upward force on the fixed die 12 due to mismatch or the like, the strain in the two columns 41 and 43 will be reduced from the pre-load strain. Therefore, a change in signal will occur, indicating that an upward force exists, and the value of the change in signal will be a function of the value of the upward force. Conversely, if a reaction force is imposed upon the die by the bolt in a downward direction, an increased strain will exist within the columns 42 and 43 which is greater than the pre-load strain, causing an increase in the value of the signal where the increased value is a function of the reaction force in the dies created by the bolts. Therefore, because the columns 42 and 43 are pre-loaded by the toe clamps, a system is provided which is capable of generating signals which are in effect both positive and negative in response to upward or downward reactive forces on the dies. Therefore, the signals indicate both the magnitude and direction of the reaction force. Consequently, the signals establish for a set-up man both the amount and direction of the adjustment which should be made.

As illustrated in FIG. 4, the microprocessor 48 is arranged to perform several functions, based upon the signals received by the microprocessor from the strain gauges 44 and 46. For example, it supplies a signal to the operator's station in a display box 51 having indicator lights 52. Such indicator lights inform the machine operator of the operating condition which exists. The operator is also provided with meters 50 which indicate the value and direction of the reaction forces. Further, the system provides an exit chute system 53 along which the rolled or threaded bolts pass after they leave the dies. Such chute system preferably provides one branch 54 along which properly formed bolts pass and a reject branch 56 for improperly rolled workpieces. A diverter door 57 is normally positioned to cause the finished workpieces to pass down along the branch 54 when the signals generated by the strain gauges 44 and 46 indicate a proper rolling process. However, when the signals generated by the strain gauges 44 and 46 deviate from the values which exist for proper rolling, such signals are interpreted by the microprocessor 48 and operate an actuator 58 which moves the deflector door to a reject position in which it blocks the branch 54 and causes the improperly formed workpiece to pass down the reject branch 56. In this way, an automatic sorting or rejection of improperly formed workpieces is achieved so as to ensure that high quality products are obtained. The microprocessor 48 is also preferably programmed so that if a rejection rate is excessive, the machine is automatically shut down until corrective measures can be taken. In such instance, a schematically illustrated brake 59 is operated to shut the machine off. For example, the microprocessor can be programmed to shut the machine off if five improperly formed workpieces are produced in succession, or if five out of ten consecutive workpieces are improperly programmed to shut the machine off in the event that damaging loads are encountered which can either damage the tooling or the machine itself.

In accordance with the present invention, the sensor system is arranged to sense the reaction forces in a direction parallel to the axis of the workpiece being threaded, the vertical forces, and to provide a signal which is not materially affected by the separating forces on the dies in a direction perpendicular to the die faces, the horizontal forces. It should be recognized that the horizontal forces are of a much higher magnitude than any vertical reaction forces. Further, variations in the horizontal forces created by improper rolling are relatively small compared to the magnitude of the horizontal force, so it is difficult to generate a satisfactorily usable signal based upon variations in the horizontal force. On the other hand, variations in the vertical forces are more significant and are of a magnitude which allows good interpretation of the rolling process. For example, mismatch between the dies and the workpiece tends to create a substantial variation in the reaction force in the direction of the workpiece axis, while the separating forces do not vary signficantly as a result of mismatch.

In accordance with this invention, the sensor beam 22 is located in the total structure so that it will not significantly react to any separating, or horizontal, forces. It should be recognized that the high magnitude separating forces, although existing in a horizontal direction, cause strain in the direction of the workpiece axis because of Poisson's Ratio. In the particular structure illustrated, the lateral separating forces tend to reduce the thickness of the die 12 and, as a consequence, tend to increase the vertical height of the die a corresponding amount determined by Poisson's Ratio. Similarly, that portion of the die block behind the die 12 is subjected to the same separating load and is caused by Poisson's Ratio to expand vertically as a result of the lateral horizontal load imposed thereon. However, the pattern of stress within the die block tends to occur in a zone between the back face of the die 12 and the stud bolts 32 and 33. Consequently, very little horizontal force-induced stress and resulting strain exist within the die block in the zone immediately adjacent to the spacer 21 and the sensor beam 22. Similarly, the spacer 21 and beam 22 are not subjected to any vertical forces created by the separating reaction forces on the dies. Consequently, the changes in stress in the columns of the sensor beam are not to any material extent a result of the separating forces between the dies. In actual tests it appears that the signal variations created by the strain gauges 44 and 46 appear to be almost entirely a function of the reaction forces created in the die in the direction parallel to the axis of the workpiece being rolled. If, on the other hand, the sensors were located within the stress zone created in the system as a result of separating forces on the dies, there would be a substantial tendency for the signals to be affected by the separating forces because of Poisson's Ratio.

In the embodiment of FIGS. 1 through 3, in which two sensors are provided, with one substantially adjacent to each end of the fixed die 12, it is possible to establish signals which indicate not only mismatch but provide an indication that the dies are not running parallel, or that the unformity of the rolling operation is not being maintained throughout the operation. When the microprocessor is utilized with a system in which two different signals are generated during the rolling operation, the microprocessor could be arranged to compare not only the value of the two signals but the timing thereof, so as to better evaluate the operation.

FIG. 5 illustrates a second embodiment in which only one signal is generated. Such embodiment utilizes a sensor beam 22', very similar to the sensor beam 22 of the first embodiment. However, the cutouts in the web are arranged to provide a central pillar 42' and two end pillars 43'. In this instance, however, only a single strain gauge 44' is provided, and that strain gauge is applied to the central pillar or column 42'.

Here again, a signal is generated which indicates whether mismatch is occurring or that other conditions of improper rolling exist. Such system is somewhat simplified in that the microprocessor need not evaluate two separate signals as in the first embodiment. In both embodiments, however, a system is provided in which the operating conditions of the machine can be determined in a full speed operating situation. Therefore, a more accurate determination of the operating conditions is possible and a higher quality product is produced.

Although the preferred embodiments of this invention have been shown and described, it should be understood that various modifications and rearrangements of the parts may be resorted to without departing from the scope of the invention as disclosed and claimed herein.

What is claimed is:

1. A thread rolling machine comprising a frame, first and second die holders mounted on said frame for movement relative to each other in a predetermined direction to effect a thread rolling operation, first and second dies respectively mounted on said first and second die holders for relative movement therewith, said dies providing opposed die faces defining a gap therebetween along which blanks roll during the operation of said machine, and force measuring means mounted on said first die holder for producing a signal which is a function of the size of selected reaction forces applied to said first die during a rolling operation, said selected forces being substantially aligned with said gap and contained in a plane substantially normal to said predetermined direction of relative movement between said die holders.

2. A thread rolling machine as set forth in claim 1, wherein such blank produces separating forces on said dies during a thread rolling operation which are transmitted through said first die holder along a zone behind said first die, and said force measuring means includes a sensor positioned on said first die holder outside said zone.

3. A thread rolling machine as set forth in claim 1, wherein said force measuring means is preloaded by the mounting of said first die and produces signals which establish both the value and direction of said selected reaction forces.

4. A thread rolling machine as set forth in claim 1, wherein said signal has a predetermined value when said dies and blank are properly matched and other values when mismatch occurs during a thread rolling operation.

5. A thread rolling machine as set forth in claim 4, rejection means on said machine for rejecting selected blanks, and control means connected to said rejection means and operable in response to said signals to cause said rejecting means to reject blanks determined by said signals to be improperly rolled.

6. A thread rolling machine as set forth in claim 5, wherein said control means including means to stop said machine when said signal means establishes that said dies and blank are mismatched.

7. A thread rolling machine as set forth in claim 1, wherein said measuring means includes a beam positioning said first die within said first die holder in a first direction substantially parallel to said selected reaction forces, said beam providing at least one column stressed by said selected reaction forces on said first die, and force measuring means on said column producing a signal which is a function of the stress in said column.

8. A thread rolling machine as set forth in claim 7, wherein said first die and said first die holder are stationary and said second die and said second die holder reciprocate back and forth with respect to said first die holder.

9. A thread rolling machine as set forth in claim 1, wherein said measuring means includes a beam positioning said first die within said first die holder in a first direction substantially parallel to said selected reaction forces, said beam providing at least two columns spaced along the length of said first die stressed by said selected reaction forces on said first die and force measuring means on each of said two columns producing a signal which is a function of the stress on the associated one of said columns, and control means comparing the values of said signals produced by said force measuring means for determining whether said dies are running parallel to each other.

10. A thread rolling machine comprising a frame, a slide reciprocably mounted in said frame, a fixed die holder mounted on said frame, a fixed die mounted on said fixed die holder, a movable die mounted on said slide for reciprocable movement therewith and relative to said fixed die during a thread rolling operation, said dies defining a gap therebetween along which blanks roll during the thread rolling operation of said machine, a sensor beam positioned along one side of said fixed die, clamping means clamping said fixed die towards said sensing beam, said sensing beam having a portion stressed by selected reaction forces applied to said fixed die during the rolling operation of said machine, said selected forces being substantially aligned with said gap and contained in a plane substantially normal to the direction of said relative movement between said fixed die and said movable die, said sensor beam having a portion stressed by said selected reaction forces, and force measuring means on said portion producing a signal having a value which is a function of the magnitude of said selected reaction forces.

11. A thread rolling machine as set forth in claim 10, wherein said beam provides separate portions spaced along the length of said fixed die, and a separate force measuring means is mounted on at least two of said separate portions.

12. A method of monitoring the operation of thread rolling machines comprising providing signal generating load cell means in the die mounting structure of one of a pair of thread rolling dies so that said load cell means are exposed to reaction forces in a direction substantially parallel to the axis of a blank being threaded and are substantially free of direct and indirect stresses resulting from separating forces, and controlling the operation of said machine in response to signals produced by said load cell means.

13. A method as set forth in claim 12, including providing said load cell means with at least two load cells spaced along the length of said pair of dies, and comparing the values of signals produced by said load cells to determine if said dies are running parallel.

14. A method as set forth in claim 12, including preloading said load cell means so that signals are produced which provide both an indication of the value of said reaction force and its direction.

15. A method as set forth in claim 12, including utilizing said signals to establish when a blank is incorrectly rolled and rejecting such incorrectly rolled blank in response to said signals.

* * * * *

UNITED STATES PATENT AND TRADEMARK OFFICE

CERTIFICATE OF CORRECTION

PATENT NO. : 4,615,197

DATED : October 7, 1986

INVENTOR(S) : Allebach

It is certified that error appears in the above-identified patent and that said Letters Patent is hereby corrected as shown below:

Column 2, line 20, "cuased" should read as --caused--.

Column 4, line 27, "a" should read as --to--.

Column 5, line 65, after "improperly" --formed. Further, the microprocessor is preferably-- should be added.

Signed and Sealed this

Third Day of February, 1987

*Attest:*

DONALD J. QUIGG

*Attesting Officer*

*Commissioner of Patents and Trademarks*